US005257593A

United States Patent [19]

van den Elshout et al.

[11] Patent Number: 5,257,593

[45] Date of Patent: Nov. 2, 1993

[54] FLOATING CONSTRUCTION ASSEMBLED FROM SEVERAL PARTS

[75] Inventors: Johannes van den Elshout, Rotterdam; Willem Groen, The Hague, both of Netherlands

[73] Assignee: I. H. C. Holland N. V., Sliedrecht, Netherlands

[21] Appl. No.: 723,485

[22] Filed: Jul. 1, 1991

[30] Foreign Application Priority Data

Jul. 30, 1990 [NL] Netherlands ..... 9001719

[51] Int. Cl.[5] ..... B63B 59/02

[52] U.S. Cl. ..... 114/263; 114/267; 405/219

[58] Field of Search ..... 114/263, 267; 405/218, 405/219; 403/221, 224, 227, 335, 337; 14/27

[56] References Cited

U.S. PATENT DOCUMENTS 4,453,488 6/1984 Watchorn ..... 114/266
4,852,509 8/1989 Fransen et al. ..... 114/263
4,962,716 10/1990 Fransen et al. ..... 114/263

*Primary Examiner*—Edwin L. Swinehart
*Attorney, Agent, or Firm*—Foley & Lardner

[57] ABSTRACT

A floating construction includes a first box-shaped floating unit having a contact plane, a second box-shaped floating unit having a contact plane, a first connecting block having a bore therein and being connected to the contact plane of the first floating unit, a second connecting block having a first bore therein and being connected to the contact plane of the second floating unit, a connecting rod, and an intermediate element. The connecting rod extends through the first bores of the first and second connecting blocks such that a clearance exist between the a respective inner surface of said first bores of said first and second connecting blocks and the connecting rod, thereby allowing relative movement between the first bores of the first and second connecting blocks and the connecting rod. The intermediate element is disposed between the first and second connecting blocks and around the connecting rod, and includes first and second disc portions which each have a side plane and a spherical contact surface. The spherical contact surfaces face each other and are formed complimentary to each other such that when the side planes are subjected to a loaded condition they self-adjust relative to a position of the contact planes of the first and second floating unit.

10 Claims, 2 Drawing Sheets

FLOATING CONSTRUCTION ASSEMBLED FROM SEVERAL PARTS

BACKGROUND OF THE INVENTION

Field of the Invention

The invention relates to a floating construction as for example a pontoon, a vessel, a pontoon bridge or a similar floating construction, assembled from several box-like floating units which are rigidly but removably connected to each other by coupling means which are provided with a connecting rod-construction.

A similar floating construction is known from EP-A-0 079 911. By assembling the floating construction from several box-like units, which are rigidly but removably connected to each other, transport of the construction to areas that are hard to reach, for example to lakes which can not be reached through waterways, can be facilitated considerably. In addition, the units can be assembled rapidly and efficiently without requiring heavy hoisting equipment. After use of the construction the units can simply be disengaged and transported.

With this known floating construction, the coupling means consist of a hollow pin which is mounted to the outer side of a side plane of one of the floating units to be connected and with coupling is led in a bush on a corresponding position on the side plane of the unit to be connected therewith, after which the hollow pin and the bush are connected to each other by means of a bolt.

This known floating construction has many disadvantages. Firstly, high requirements should be made to ensure the accuracy of the manufacturing of the coupling means and the mounting of this means to the floating units. The bush and the hollow pin to be led therein, each of which is fastened to another floating unit, have to fit precisely together.

Further, with the known construction the planes to be connected of the floating units are coupled to each other at the four corners. This is a statically overdetermined connection which, regarding the relatively large dimensions of the floating units, can lead to serious mounting problems when fastening the fourth junction because the hollow pin can not be led into the bush. Furthermore, this coupling means forms projecting parts on the floating units which is difficult during transport of these units.

SUMMARY OF THE INVENTION

The object of the invention is to provide a floating construction assembled from several box-like floating units with which the aforementioned problems are overcome in a simple way and with which the processing costs are relatively low.

According to the invention this object is achieved in that the connecting rod extends with wide clearance through bores or slots in adjacent connecting blocks. The blocks are fastened at corresponding positions to the planes to be connected with each other of the floating units. An intermediate element is present between these connecting blocks and around the connecting rod. The side planes of the intermediate element adjustable or deformable in under loaded conditions such that these side planes can adjust themselves to the position of the contact planes of the connecting blocks coacting with the intermediate element.

Through this large manufacturing tolerances are permitted so that large deviations and clearances in relation to the normal dimensioning can be achieved when creating the coupling construction so that in the manufacturing process no highly accurate dimensioning processes are required. A construction of this type offers a very large level of adjustability while minimizing processing costs.

According to the invention it is preferred that the connecting rod be secured with a certain pretension. Through this tension and due to the greater friction created, higher transverse forces can be absorbed by the connection.

The adjustment of the side planes of the intermediate element to the contact planes of the connecting blocks coacting therewith can be attained in several ways. According to the invention the intermediate element can at least, at the position of the side planes, be manufactured from a softer material than the material of the contact planes of the connecting blocks coacting with the intermediate element.

However, it is also possible that in the transverse direction the intermediate element is divided into two or more discs the facing contact planes of which are formed complimentary to each other in a spherical shape.

In order to accommodate greater transverse forces in the connection, a further development of the invention provides the side planes of the intermediate element, which coact with the contact planes of the connecting blocks, with grooves, irregularities or friction material.

With connections where the coupling menas is mounted at least on or near the four corners of the planes of the floating units to be connected, a further development of the invention provides that at least one of the coupling means lies above water with an adjusting element adjacent the intermediate element by which the space between the planes that are to be connected with each other can be filled up.

In this way, the extra clearances can be accommodated which can arise in that the connection between both floating units is statically overdetermined. The adjusting element can be in the form of an adjusting ring the thickness of which above water can be measured after the three other joints have been secured. It is for example, also conceivable to form the adjustable element as a wedge construction with which for example, a forked wedge is slid over the connecting rod and with which the sloping side of the wedge can coact with a side plane of the intermediate element which has a corresponding slope.

According to the invention, a particularly advantageous embodiment of the floating construction is obtained when the coupling means further consists of identical, prefabricated and essentially cubical connecting blocks, which are provided with three bores or slots extending in the main directions of the block and which are at right angles to each other for receiving the connecting rod with a large amount of play. Through this the connecting blocks can advantageously be manufactured in a large series, and with one standard connecting block coupling of the three main directions is possible, namely in the horizontal plane, in the longitudinal direction in the transverse direction, and in a vertical direction with the stacking and coupling of the units.

According to a further development of the invention, in each case, one of both floating units to be connected is provided with an with respect to this floating unit watertight closed space, adjacent to the connecting block, for receiving the end portion of the connecting rod as well as the holding means for the axial fixation of this rod.

The holding means can be in the form of, for example, a hammer-like head of a tee bolt, but it can also consist of a loose nut which is locked against rotation by means of seen locking element.

According to the invention in the other end of the connecting rod opposite to the closed space can be provided with sealing means with respect to the bore in the connecting block.

By both of these features, connections below water level are possible without the floating units being filled up with water.

BRIEF DESCRIPTION OF THE DRAWINGS

The invention will now be described in more detail by means of embodiments illustrated in the drawings, wherein:

FIGS. 1 and 2 show a floating construction in the form of a pontoon, assembled from three identical box-like units 1*a*, 1*b* and 1*c*, which for example can be of standard container dimensions, as well as from end units 2 and 3. The assembling units are rigidly but removably connected head-to-head with each other to form a single entity through coupling means 4. In this embodiment, the coupling means consists of four pairs of identical, prefabricated and essentially cubical connecting blocks 5, which are mounted on or near the corners of the floating units at corresponding positions of the planes to be connected and which are provided with bores 6 or slots 7 (see FIGS. 3, 4 and 5) for receiving with a large play a connecting rod 8, which is provided with screwthread at both ends, by which the adjacent connecting blocks are connected to each other.

As shown in FIG. 3 each connecting block 5 has three bores 6, 6', 6" which in three main directions 9, 10 and 11 respectively, and which are at right angles to each other, so that the floating units can be coupled to each other in three different directions; namely head-to-head, side-by-side and on top of each other.

FIG. 4 shows in section and in more detail one of the four joints between two adjacent floating units 1*a* and 1*b*. Between the adjacent connecting blocks 5*a* and 5*b* an intermediate element 12 is present around the connecting rod 8. In transverse direction this intermediate element is divided into two discs 13, 14 of which the respective contact planes 15, 16 face each other and are formed as complimentary spherical surfaces. Because of this feature the side planes 17, 18 of the intermediate element 12 can adjust themselves to the position of the contact planes 19, 20 of the connecting blocks coacting with the intermediate element. Alternatively, as shown in this embodiment, this adjustment can take place at the right side through an adjusting ring 21. These adjustment properties can also be obtained by forming the intermediate element 12 as a bush or a ring that is manufactured from a soft material.

Figure 1:
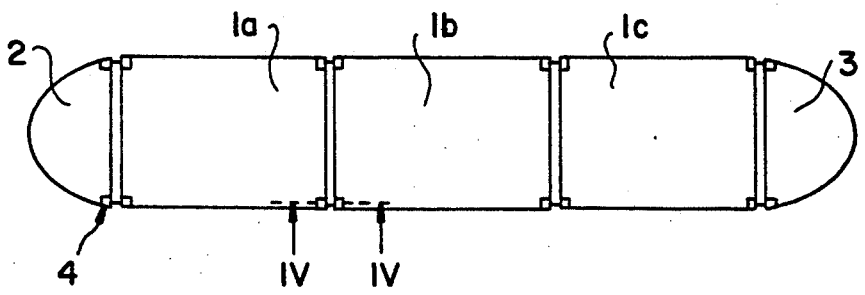
FIG. 1 is a diagrammatical plan view of a floating construction according to the invention.
Figure 2:
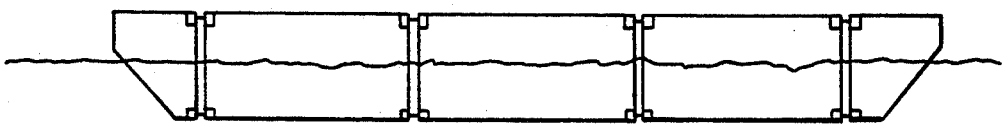
FIG. 2 is a side elevation view of the construction according to FIG. 1.
Figure 3:
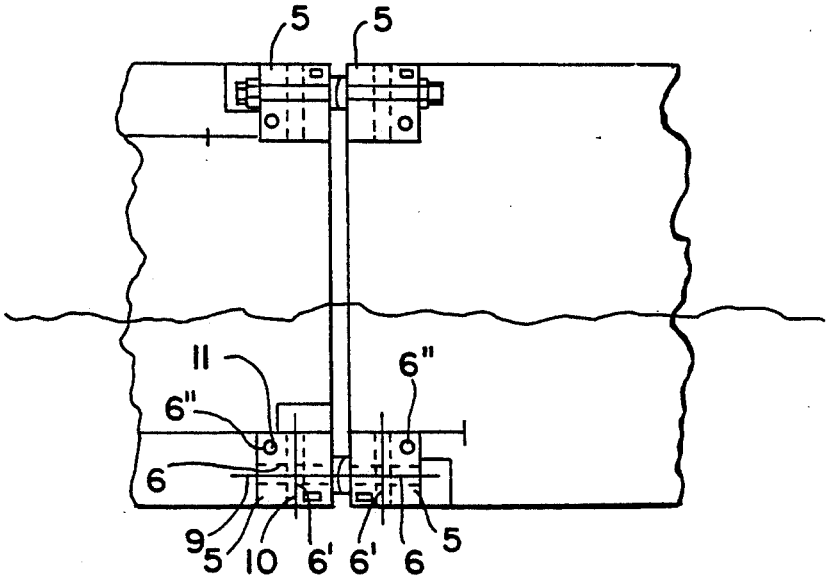
FIG. 3 shows one detail of FIG. 2 on an enlarged scale.

In order to be able to take up greater transverse forces in the connection, the side planes 17, 18 of the intermediate element can be provided with grooves, irregularities or friction material, each of which is schematically represented by numeral 27.

In order to be able to take up even larger clearances and deviations, which can occur for example with the securing of the fourth joint due to the statically overdetermined character of the connection, an adjusting member 21 can be provided next to the intermediate element, by which the space between both planes 19, 20 to be connected can be filled up. In the embodiment shown in FIG. 4, the adjustment member consists of an adjustment ring or a filling ring 21, the thickness of which can be measured above water after the three joints have been secured. It is naturally also conceivable that one of the discs 13, 14 should have to be slightly turned off.

Figure 4:
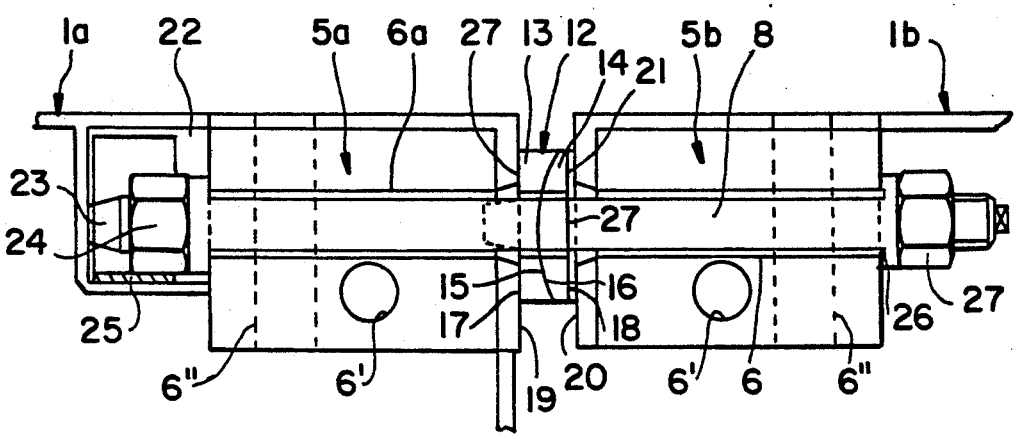
FIG. 4 shows a sectional view on a more enlarged scale according to the line IV—IV of the secured connection in FIG. 1.

FIG. 4 further shows a watertight closed space 22, being adjacent to the connecting block 5*a* which serves to receive the end portion 23 of the connecting rod 8 as well as the holding means 24 for the axial fixation of this rod. In this embodiment, the holding means consists of a nut 24 which is locked against rotation by means of a U-shaped locking element 25.

At the other side, the connecting rod 8 is provided with sealing means 26 in relation to the bore 6 in the connecting block 5*b*.

Figure 5:
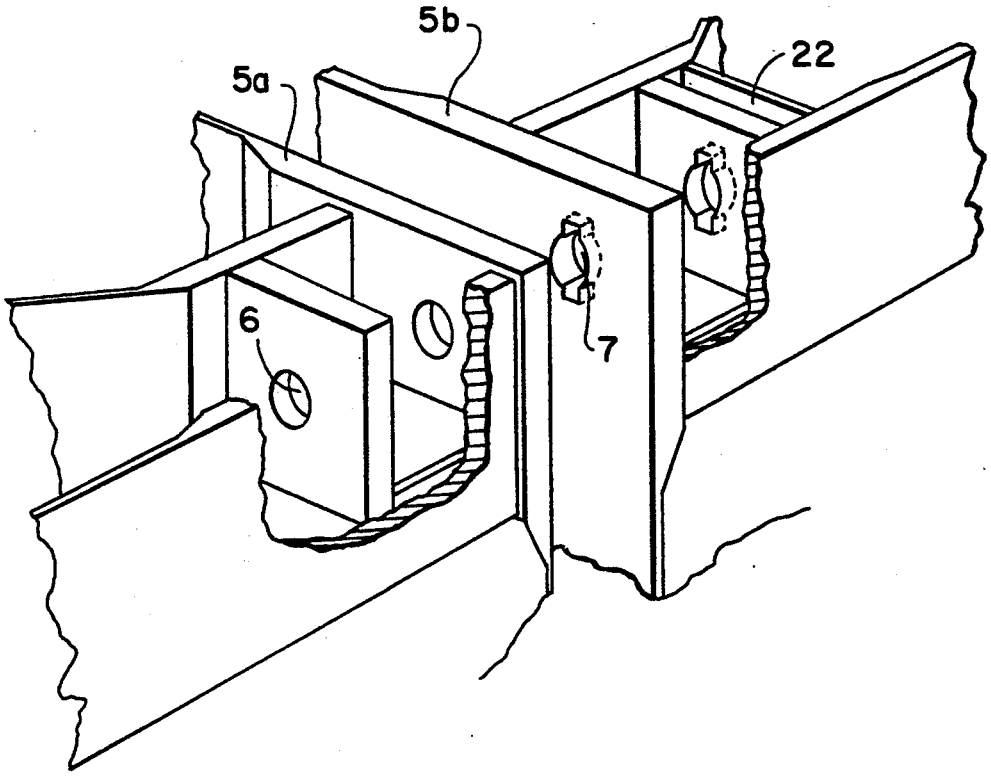
FIG. 5 is a perspective view of an alternative embodiment of the connecting blocks, certain parts of which have been omitted in the interest of clarity.

Instead of a connecting rod, a tee bolt could, for example, be applied. In that case, as shown in FIG. 5, one of both connecting blocks is provided with slots 7 for leading through the hammer-like head.

With the coupling of two floating units by means of four joints, usually three of the four joints will not use an adjusting member 21.

During the coupling, the conical end portion 23 of the connecting rod 8 projects in the starting position slightly past the intermediate element 12, as illustrated in FIG. 4 by a broken line. The intermediate element can be locked on the connecting rod against loss with the aid of a breaking pin, which is not shown. After the connecting block 5*a* with its bore 6*a* has been brought in front of the hole in relation to the bore 6 in the connecting block 5*a*, the rod 8 is hit through the bore 6*a* with a hammer whereby said breaking pin breaks off. Then the outermost end of the rod 8 is screwed into the nut 24. After this the connecting rod is brought under the required pretension by means of a hydraulic lifting jack at the other side, whereupon the nut 27 is secured.

It will be understood that the invention is not limited to the embodiments described in the foregoing, which can be varied in several ways within the scope of the invention.

We claim:

1. A floating construction, comprising:

a box-shaped floating unit having a contact plane;

a second box-shaped floating unit having a contact plane;

a first connecting block having a first bore therein and being connected to said first floating unit contact plane;

a second connecting block having a first bore therein and being connected to said second floating unit contact plane;

a connecting rod extending through said first bores of said first and second connecting blocks such that a clearance exists between a respective inner surface of said first bores of said first and second connecting blocks and said connecting rod thereby allowing relative movement between said first bores of said first and second connecting blocks and said connecting rod; and an intermediate element being disposed between said first and second connecting blocks and around said connecting rod, said intermediate element including first and second disc portions which each have a side plane and a spherical contact surface, wherein said spherical contact surfaces face each other and are formed complimentary to each other, and when said side planes are subject to a loaded condition they self-adjust relative to a position of said contact planes of said first and second floating units.

2. A floating construction as recited in claim 1, wherein said side planes include a first side plane which contacts said first floating unit contact plane and a second side plane which contacts said second floating unit contact plane, and said first and second side planes include at least one of grooves, irregularities and friction material.

3. A floating construction according to claim 1, further comprising an adjusting member disposed adjacent said intermediate member, and wherein said adjusting member can be adjusted to fill a space defined between said contacting planes of said first and second floating units.

4. A floating construction according to claim 1, wherein said first connecting block has second and third bores, said second connecting block has second and third bores, said first, second and third bores of said first connecting block are at right angles to each other, and said first, second, and third bores of said second connecting block are at right angles to each other.

5. A floating construction as recited in claim 1, wherein one of said first and second box-shaped floating units includes a water tight closed space adjacent to one of said first and second connecting blocks, and further comprising a means for fixing an axial position of said connecting rod, said fixing means being operatively connected to a first end portion of said connecting rod and being disposed in said water tight closed space.

6. A floating construction as recited in claim 1, further comprising a means for sealing said clearance in one of said first and second connecting blocks.

7. A floating construction as recited in claim 1, wherein said connecting rod is secured with a certain predetermined tension.

8. A floating construction as recited in claim 1, wherein said side planes are made from a material which is softer than a material from which said contact planes of said first and second floating units are made.

9. A floating construction, comprising:

a first box-shaped floating unit having a contact plane;

a second box-shaped floating unit having a contact plane;

a first connecting block having a first bore therein and being connected to said first floating unit contact plane;

a second connecting block having a second bore therein and being connected to said second floating unit contact plane;

a connecting rod extending through said first bores of said first and second connecting blocks such that a clearance exists between a respective inner surface of said first bores of said first and second connecting blocks and said connecting rod thereby allowing relative movement between said first bores of said first and second connecting blocks and said connecting rod; and an intermediate element 1) having first and second side planes which include at least one of grooves, irregularities and friction material and 2) being disposed between said first and second connecting blocks and around said connecting rod, wherein when said first and second side planes are subject to a loaded condition they self-adjust relative to positions of said contact planes of said first and second floating units such that said first side plane contacts said first floating unit contact plane and said second side plane contacts said second floating unit contact plane, and said at least one of said grooves, irregularities and friction material permits said floating construction to withstand an increased loaded condition;

wherein said first and second box-shaped floating units are rigidly connected to each other due to said connecting rod and the contact between said first side plane and said first floating unit contact plane and the contact between said second side plane and said second floating unit contact plane.

10. A floating construction, comprising:

a first box-shaped floating unit having a contact plane;

a second box-shaped floating unit having a contact plane;

a first connecting block having a first bore, a second bore and a third bore therein and being connected to said contact plane of said first floating unit;

a second connecting block having a first bore, a second bore and a third bore therein and being connected to said contact plane of said second floating unit;

a connecting rod extending through one of said first, second and third bores of said first connecting block and one of said first, second, and third bores of said second connecting block such that a clearance exists between a respective inner surface of said one of said first, second and third bores of said first connecting block and said one of said first, second, and third bores of said second connecting block and said connecting rod, thereby allowing relative movement between said one of said first, second and third bores of said first connecting block and said connecting rod and between said one of said first, second and third bores of said second connecting block and said connecting rod; and an intermediate element having first and second side planes and being disposed between said first and second connecting blocks and around said connecting rod, wherein when said first and second planes are subject to a loaded condition they self-adjust relative to a position of said contact planes of said first and second floating units;

wherein said first, second and third bores of said first connecting block are perpendicular to each other and said first, second, and third bores of said connecting block are perpendicular to each other thereby allowing said first and second connecting blocks to be connected to additional connecting blocks.

* * * * *